United States Patent [19]

Stähle

[11] 3,958,723

[45] May 25, 1976

[54] AUTOMATIC VOLUME CONTROL FOR CENTRIFUGAL PUMPS

[76] Inventor: Martin Stähle, Postfach 12, 8213 Neunkirch, Switzerland

[22] Filed: Apr. 23, 1975

[21] Appl. No.: 570,767

[30] Foreign Application Priority Data

Apr. 25, 1974 Switzerland ..... 005645/74

[52] U.S. Cl. ..... 222/282; 137/810; 222/377; 415/116

[51] Int. Cl.[2] ..... G01F 11/06

[58] Field of Search ..... 222/282, 377; 415/116; 137/808–813

[56] References Cited

UNITED STATES PATENTS 3,545,468 12/1970 Freeman et al. ..... 137/810 X

*Primary Examiner*—Stanley H. Tollberg
*Assistant Examiner*—David A. Scherbel
*Attorney, Agent, or Firm*—Lyon & Lyon

[57] ABSTRACT

An automatic volume control for centrifugal pumps wherein a centrifugal pump is arranged with its suction oriface facing downwardly into an open top tank having a tangential feed channel. The tank is placed in a receiver for the liquid to be pumped, at a level wherein the tank and the feed channel is submerged below the intended maximum liquid level. An upwardly directed air line outlet may be placed in the bottom of the tank in axial alignment with the pump.

7 Claims, 8 Drawing Figures

AUTOMATIC VOLUME CONTROL FOR CENTRIFUGAL PUMPS

BACKGROUND OF THE INVENTION

Centrifugal pumps are often used to raise liquids from a lower level to a higher level, such as raising waste water from a sump. If the delivery from the pump is not regulated, the centrifugal pumps must be operated intermittently, which is, especially in the case of sewage plants, undesirable. Various methods of regulating delivery are known. For example, delivery may be reduced by throttling the outlet or pressure line, which causes increased co-rotation and corresponding reduction in fluid flow through the pump.

Another method of reducing delivery utilize a suction tube so placed with respect to the inlet of the pump as to induce increased suction through the suction tube in a manner to induce increased rotational fluid flow an attendent reduction in pump delivery as the level of the liquid drops. In practice, the pump delivery may be reduced to about half the maximum delivery; however, in many cases it is desirable to obtain regulation over the entire range, between zero output and maximum delivery.

SUMMARY OF THE INVENTION

The present invention is directed to an automatic volume control for centrifugal pumps which overcomes the disadvantages indicated.

A primary object of the present invention is to provide an economical solution to the problem by technically simple means, More particularly, the suction oriface of the pump housing, surrounding the turbine wheel inlet, is submerged in an open top tank which is connected to a tangentially disposed fluid feed channel; the tank being positioned below the intended maximum liquid level so that at maximum level the liquid passes radially over the rim of the tank; then, as the liquid level is reduced, the tangential channel induces increased rotational movement of the liquid, with attendent reduction in delivery from the pump.

A further object if to provide an automatic volume control for centrifugal pumps wherein, if the liquid level falls below the inlet end of the tangential channel, a condition is established at which the liquid merely co-rotates with the pump and is not carried through the pump; then upon subsequent rise of the liquid level, liquid is again delivered through the pump.

A further object is to provide an automatic control for centrifugal pumps, wherein, to aid in the control of liquid movement through the pump, an air jet is directed axially into the inlet of the pump.

Figure 1:
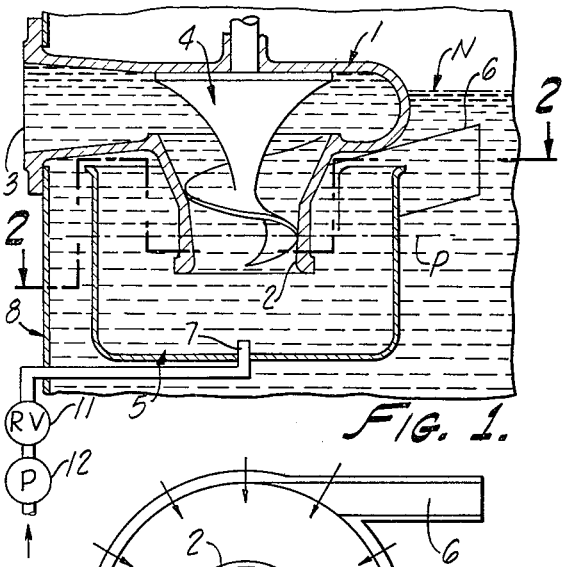
FIG. 1 is a fragmentary sectional view, shown diagrammatically, of a centrifugal pump and the automatic volume control; showing liquid flow under the condition of maximum delivery.

The automatic volume control is adapted for use in conjunction with a conventional centrifugal pump having a housing 1 forming a downwardly directed inlet or suction orifice 2 and a laterally directed outlet or discharge orifice 3. The housing 1 receives a turbine 4.

In the present invention, the lower portion of the pump housing is placed in a tank 5 having a tangential entrance channel 6 sloping downward toward the tank 5. Centered in the tank and in axial alignment with the suction orifice 2 is the discharge end of an air line 7.

The assembly including the pump 1 and tank 5 is placed a receiver 8 which may be a larger tank, sump or the like.

Figure 2:
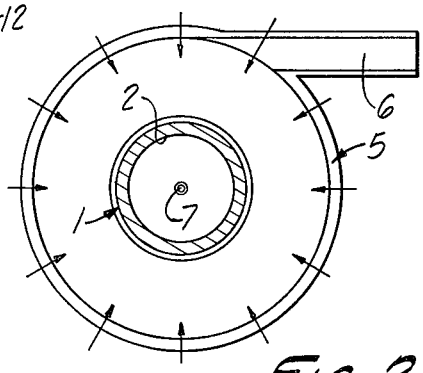
FIG. 2 is a plan view of the control tank and a sectional view of the inlet end of the pump, taken through 2—2 of FIG. 1.

Referring to FIGS. 1 and 2, when the tank 5 is submerged in the liquid to be pumped as indicated by the liquid surface N, and the pump is operated, liquid moves radially over the rim of the tank 5 and into the suction orifice 2. Under this condition, the tangential channel 6, which is intended to create rotation of the liquid, is practically ineffective; thus, no rotation of the liquid occurs before entering the pump. Within the pump, the liquid rotates and is discharged. Under this condition, the zero line of static pressure is denoted by the letter P and the liquid is within the pump essentially free of vortex voids, although the liquid may include entrained gas. Also, air may be introduced through the air line 7.

Figure 3:
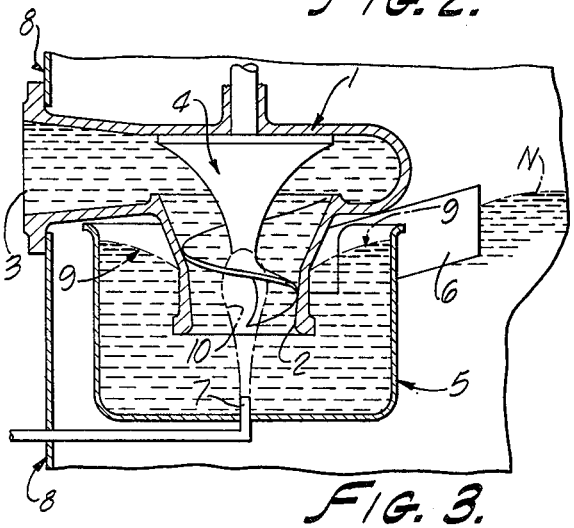
FIGS. 3 and 4 are views corresponding respectively to FIGS. 1 and 2, showing liquid flow under the condition of partial delivery.
Figure 4:
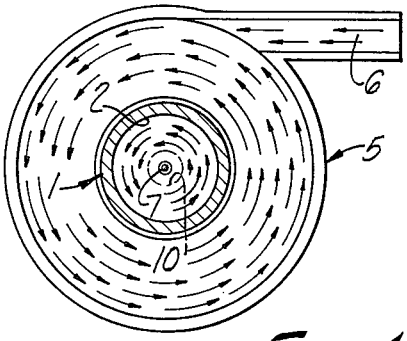
Figure 8:
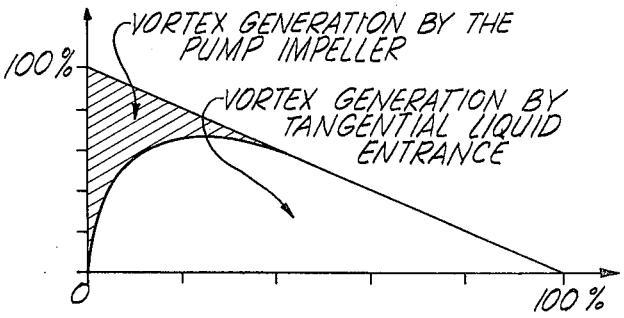
FIG. 8 is a diagram showing the rotative current in the tank versus the pump delivery.

Referring to FIGS. 3 and 4, if the rate at which water is supplied to the receiver 8 decreases, reulting in lowering the surfce N of the water so that the water is supplied exclusively through the feed channel 6, a rotative current is produced, producing a vortex or funnel-shaped water surface in the tank below the rim thereof as indicated by 9. The turbine wheel, which rotates in the same direction, arrangements the vortex current in the tank causing the creation of a vacuum in the region of the suction orifice 2 so that a core 10 of air is formed aided by a jet of air from the air line 7.

Figure 7:
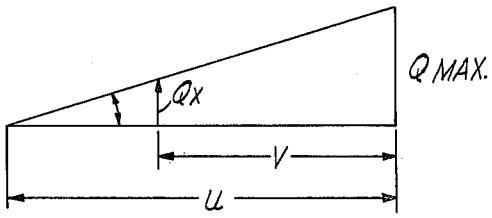
FIG. 7 is a velocity triangle at the inlet of the centrifugal pump equipped with the volume control.

The annular current represented by the annulus surrounding the core 10 in FIG. 4, thus created at the suction orifice 2 rotates at a speed which is less than the peripheral speed of the turbine wheel 4 but brings about a corresponding reduction in the delivery Qx as indicated in FIG. 7.

As the liquid supply is further reduced, the liquid level drops in the tank 5, thus reducing the head in the feed channel 6; that is, despite reduced liquid supply, the rotational speed of the mass of liquid in the tank 5 increases, together with the vacuum in the core 10 while the radial thickness of the annular current and quantity of liquid delivered is reduced.

Figure 5:
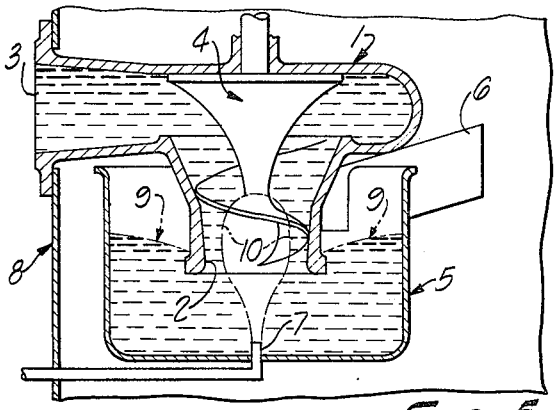
FIGS. 5 and 6 are views corresponding respectively to FIGS. 1 and 2, showing the condition of zero liquid flow.
Figure 6:
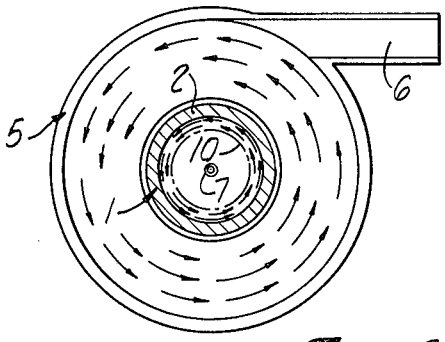

It should be noted that the turbine wheel 4 submerged in the annular current, increasingly asists or maintains the rotation of the mass of liquid in the tank 5, as the mass of liquid decreases in volume. In fact, the turbine wheel is solely responsible for such rotary motion when the water supply ceases entirely, as shown in FIGS. 5 and 6; that is, when its peripheral margin is below the intake end of the channel 6, and the suction oriface is below the surrounding water level, while the air core 10 has expanded to its largest extent.

The expanded air core 10 enables a radially, relatively thin annular current to be maintained at the suction orifice 2, while the lower peripheral portion of the turbine wheel 4 remains submerged and the portion of the turbine wheel 4 above the core 10 is fully submerged. The discharge from the outlet 3 becomes zero, when the rotational speed of the liquid is equal to the peripheral speed of the turbine wheel 4. As the tank 5 is cylindrical and coaxial with the turbine wheel 4, the result is a practically unrestrained rotary current.

It is apparent from the foregoing that, by means of the apparatus and method described, a fully automatic regulation of pump delivery between zero and maximum in relation to the liquid feed occurs without any interruption of the liquid column in the pump housing. Tests have shown that the formation of a perfect core of air at reduced delivery is especially important. It is therefore desirable to control the pressure of the incoming air, this may be accomplished by a pump 11 and regulator valve 12, as indicated in FIG. 1. If, for example, the pump is operating with a vacuum of 0.5m water column, the static pressure zero line P is raised and the water level in the tank drops. At zero delivery, this could result in the suction orifice 2 being exposed so that air would force its way between the suction orifice and the surface of the water. This can be countered by increasing the internal diameter of the suction orifice. Also the height of the tank 5 could be reduced.

Having fully described my invention it is to be understod that I am not to be limited to the details herein set forth, but that my invention is of the full scpe of the appended claims.

I claim:

1. A device for regulating the delivery from a constant speed centrifugal pump disposed for rotation about a vertical axis with its inlet end arranged for upward flow of liquid into the pump from a body of liquid, said device comprising:

a. a cylindrical tank member open at its upper side and defining a marginal rim;

b. said tank member adapted to be disposed below the maximum surface level of the body of liquid;

c. the lower portion of the pump, including the inlet and being disposed within the tank member below the marginal rim and concentric therewith;

d. said pump, when the surface level of the body of water is above the marginal rim, causing radial movement of liquid over the rim of the tank member to the pump inlet end;

e. said pump, when the liquid in the tank member is isolated from the body liquid, causing rotational movement of the liquid and producing a vortex preventing discharge of liquid from the tank through the pump.

2. A device as defined in claim 1, wherein:

a. an upwardly open feed channel member communicates tangentially with the tank said feed channel member being operable, when the liquid in the tank is below the rim of the tank member but connected to the body of liquid, to cause rotary movement of liquid in the tank before entry into the pump inlet end, thereby to reduce the rate of discharge of liquid from the tank through the pump.

3. A device as defined in claim 2, wherein:

a. the feed channel member is inclined downward from its entrance end toward the tank member.

4. A device as defined in claim 1, wherein:

a. an air outlet is directed coaxially into the pump inlet end;

b. and means are provided for controlling the air pressure at said air outlet.

5. A means for effecting decrease in the rate of discharge of a liquid from a body of such liquid as the surface of the liquid subsides from a predetermined maximum level, said means comprising:

a. a centrifugal pump having a vertical axis and provided with an inlet end for upward flow of liquid into the pump;

b. a tank member receiving the inlet end of the pump and including an entrance end surrounding the pump at a level above the pump inlet end;

c. the tank member and pump being disposed in said body of liquid with the entrance end of the tank memer below the maximum level of the body of liquid, whereby upon operation of the pump, liquid is moved radially across the entrance end of the tank member to the inlet end of the pump to effect maximum discharge of liquid from the pump;

d. said tank member, when the liquid level therein is at a preselected level between the entrance end of the tank member and the inlet end of the pump, isolating the liquid within the tank member from the surrounding body of liquid;

e. said pump, when said tank liquid is at said preselected level causing rotational movement of the tank liquid producing a vortex preventing discharge of liquid from the tank through the pump.

6. A device as defined in claim 5, wherein:

a. a feed passage communicates tangentially with the tank in the region between the entrance end of the tank and said preselected level to induce rotation of the tank liquid and induce and a corresponding vortex limiting discharge of liquid from the pump.

7. A device as defined in claim 6, wherein:

a. an air outlet is directed coaxially into the pump inlet to aid in inducing said vortex.

* * * * *